US007108567B1

(12) United States Patent
Korsunsky et al.

(10) Patent No.: US 7,108,567 B1
(45) Date of Patent: Sep. 19, 2006

(54) ELECTRICAL DEVICE FOR INTERCONNECTING TWO PRINTED CIRCUIT BOARDS AT A LARGE DISTANCE

(75) Inventors: Iosif R. Korsunsky, Harrisburg, PA (US); Kevin E. Walker, Hershey, PA (US); Lewis R. Johnson, Dover, PA (US); Tod M. Harlan, Mechanicsburg, PA (US); Robert W. Brown, Harrisburg, PA (US); Richard Malehorn, II, York, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/268,949

(22) Filed: Nov. 7, 2005

(51) Int. Cl.
*H01R 13/502* (2006.01)

(52) U.S. Cl. ..... 439/701; 439/74

(58) Field of Classification Search ..... 439/701, 439/684, 687, 731, 74, 75; 361/785
See application file for complete search history.

(56) References Cited

U.S. PATENT DOCUMENTS 5,575,686 A * 11/1996 Noschese ..... 439/620
6,394,822 B1 5/2002 McNamara
6,537,087 B1 3/2003 McNamara et al.
6,923,659 B1 * 8/2005 Zhang et al. ..... 439/74
7,025,605 B1 * 4/2006 Lang et al. ..... 439/75
2005/0070136 A1 * 3/2005 Korsunsky et al. ..... 439/74

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical device (100) for interconnecting two parallel printed circuit boards at a large distance includes a plug connector (1), a receptacle connector (1'), and a mating extender (2) disposed between the plug connector and the receptacle connector. The mating extender includes a sub-assembly of wafer (21), a pair of identical caps (20) disposed on the top and bottom portions of the subassembly of wafer, and a pair of shroud-halves (22) sliding on the subassembly of the wafer. The subassembly of wafer is made up of a number of wafer modules (24) parallel with each other. Each wafer module has a wafer support (26) and a number of contacts (28) embedded in the wafer support.

12 Claims, 12 Drawing Sheets

ELECTRICAL DEVICE FOR INTERCONNECTING TWO PRINTED CIRCUIT BOARDS AT A LARGE DISTANCE

CROSS-REFERENCE TO RELATED APPLICATION

This patent application relates to an earlier filed co-pending U.S. patent application Ser. No. 11/040,282, entitled "MATING EXTENDER FOR ELECTRICALLY CONNECTING WITH TWO ELECTRICAL CONNECTORS", filed on Jan. 20, 2005 and assigned to the same assignee as the present invention.

BACKGROUND OF THE INVENTION

1. Field of the Invention

The present invention relates to an electrical device for interconnecting two printed circuit boards (PCBs), and more particularly to an electrical device for interconnecting two parallel PCBs at a large distance.

2. Description of the Prior Art

Board mountable connectors are widely used to establish electrical connections between two separated PCBs. Usually, there are two connectors, a plug connector and a receptacle connector, respectively mounted onto the two separated PCBs and engagable with each other. However, in some situations, PCBs may be positioned at a large distance, thus in order to interconnecting two PCBs, the plug and the receptacle connectors have to span and thus would be fairly tall. U.S. Pat. No. 6,394,822 B1 discloses such an electrical connector assembly comprising a plug and a receptacle. The plug and the receptacle both comprise a number of parallel modules. Each module comprises an insulative support, a plurality of signal contacts attached on one side of the support and a shielding plate attached on another side of the support. Thus, in order to satisfy a relatively higher mating height, the plug, the receptacle and the modules have to span, thereby accordingly complicating the manufacture process and increasing product cost.

One solution to the above issue is to provide two identical board mountable connectors respectively mounted on the two PCBs, and an extender engagable with the board mountable connectors.

Accordingly, there is a need for providing an effective and economical solution for the requirement of a high stack height application. To that end, the use of some kind of cost-effective PCB interconnection device, which ensures reliable electrical connection between two PCBs and provides an easy assembly, is desirable.

BRIEF SUMMARY OF THE INVENTION

It is an object of the present invention to provide an electrical device with a simplified structure for interconnecting two parallel printed circuit boards at a large distance.

In order to attain the objective above, an electrical device for interconnecting two parallel printed circuit boards (PCBs) at a large distance includes a plug connector, a receptacle connector respectively mounted on the above PCBs, a mating extender disposed between the plug and the receptacle connectors. The mating extender includes a subassembly of wafer, two side shroud-halves sliding on the subassembly of wafer, and a pair of parallel caps disposed on the top and the bottom portion of the subassembly of wafer. The subassembly of wafer includes a plurality of parallel of wafer modules. Each wafer module defines a wafer support and a plurality of contacts embedded in the wafer support. The wafer support includes a first side defining a plurality of holes and a second side opposite to the first side forming a plurality of posts. Multiple posts of the wafer support presses into the holes of the neighboring wafer support, thus hold the subassembly of wafer together.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
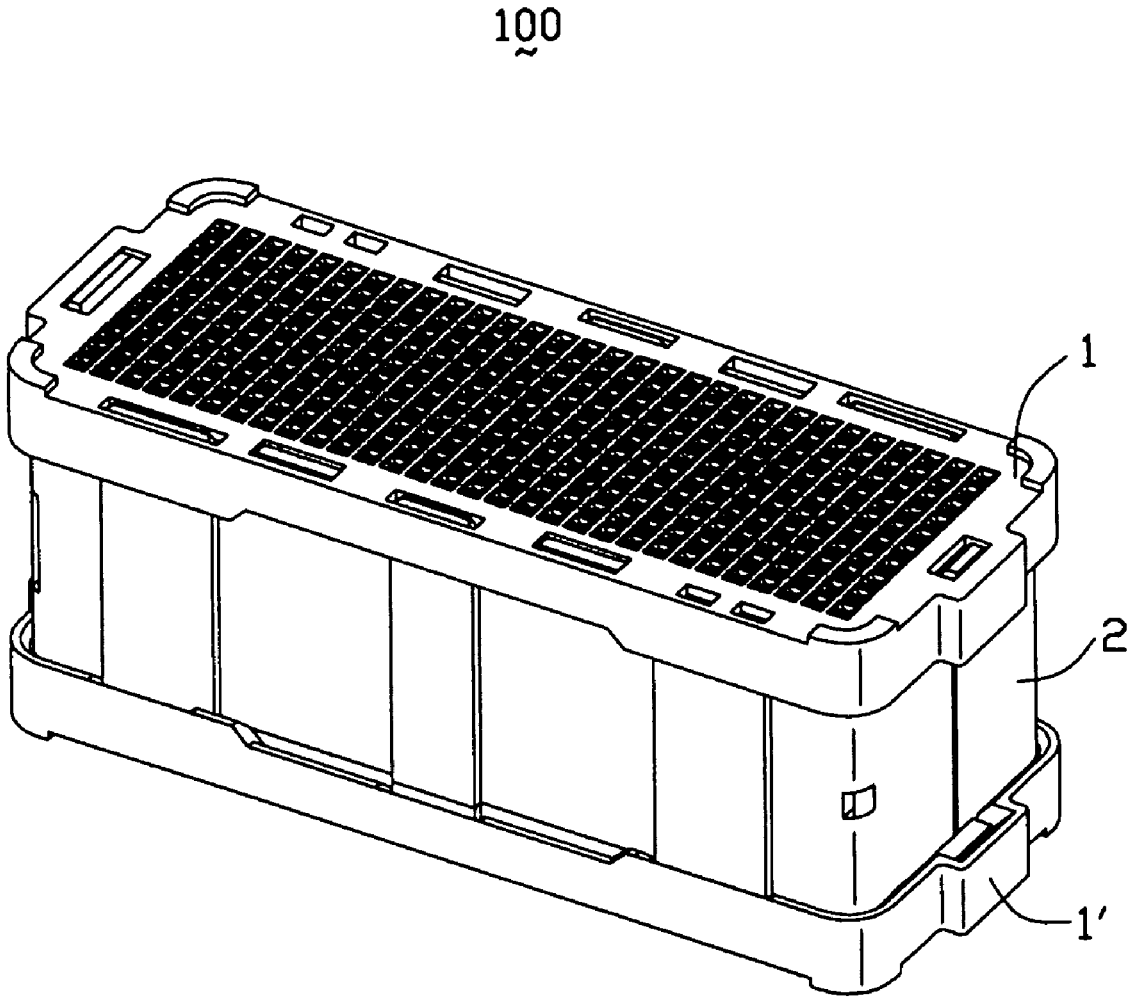
FIG. 1 is a perspective view of an electrical device according to the present invention.
Figure 2:
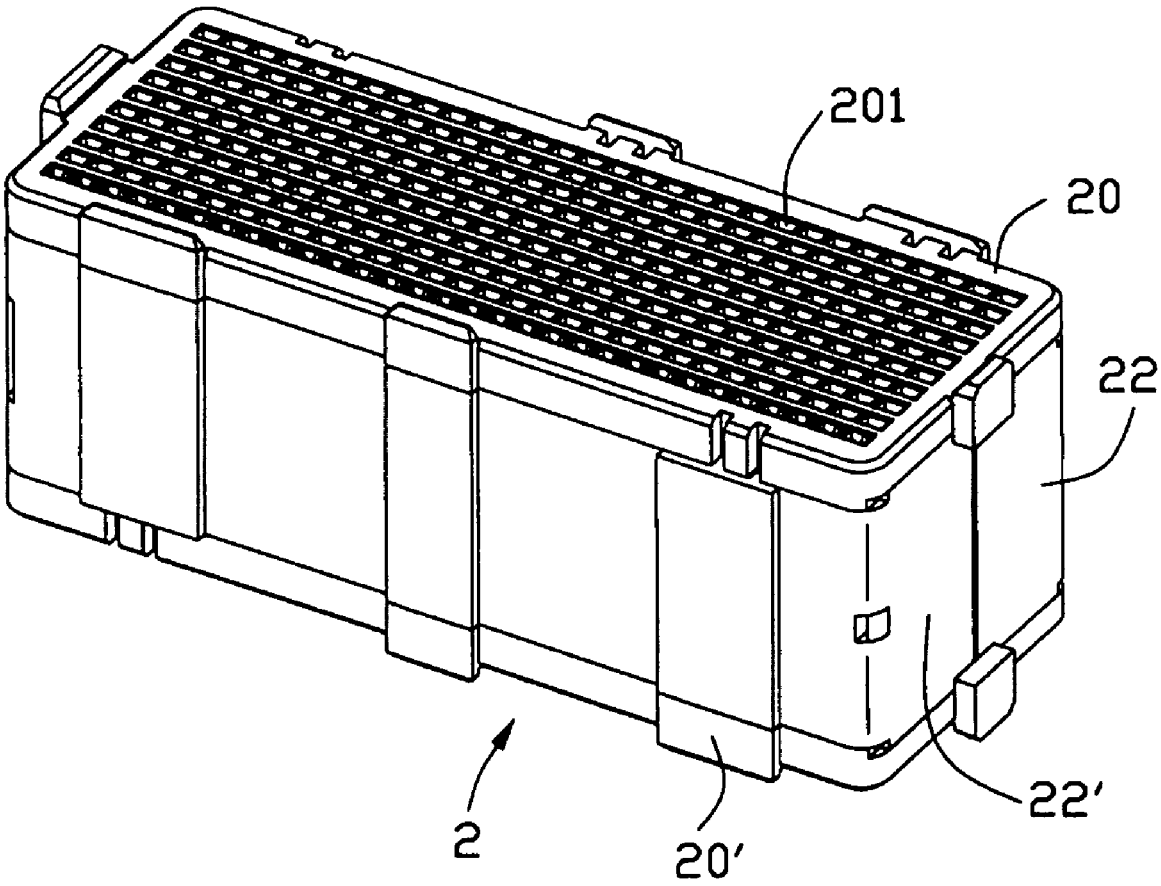
FIG. 2 is a perspective view of a mating extender of the electrical device.

Refer to FIGS. 1–2, an electrical device for interconnecting two parallel printed circuit boards (PCBs, not shown) at a large distance includes a plug connector 1, a receptacle connector 1' which is identical to the plug connector 1 in structure and parallel to the plug connector, and a mating extender 2 disposed between the plug connector 1 and the receptacle connector 1'.

Figure 3:
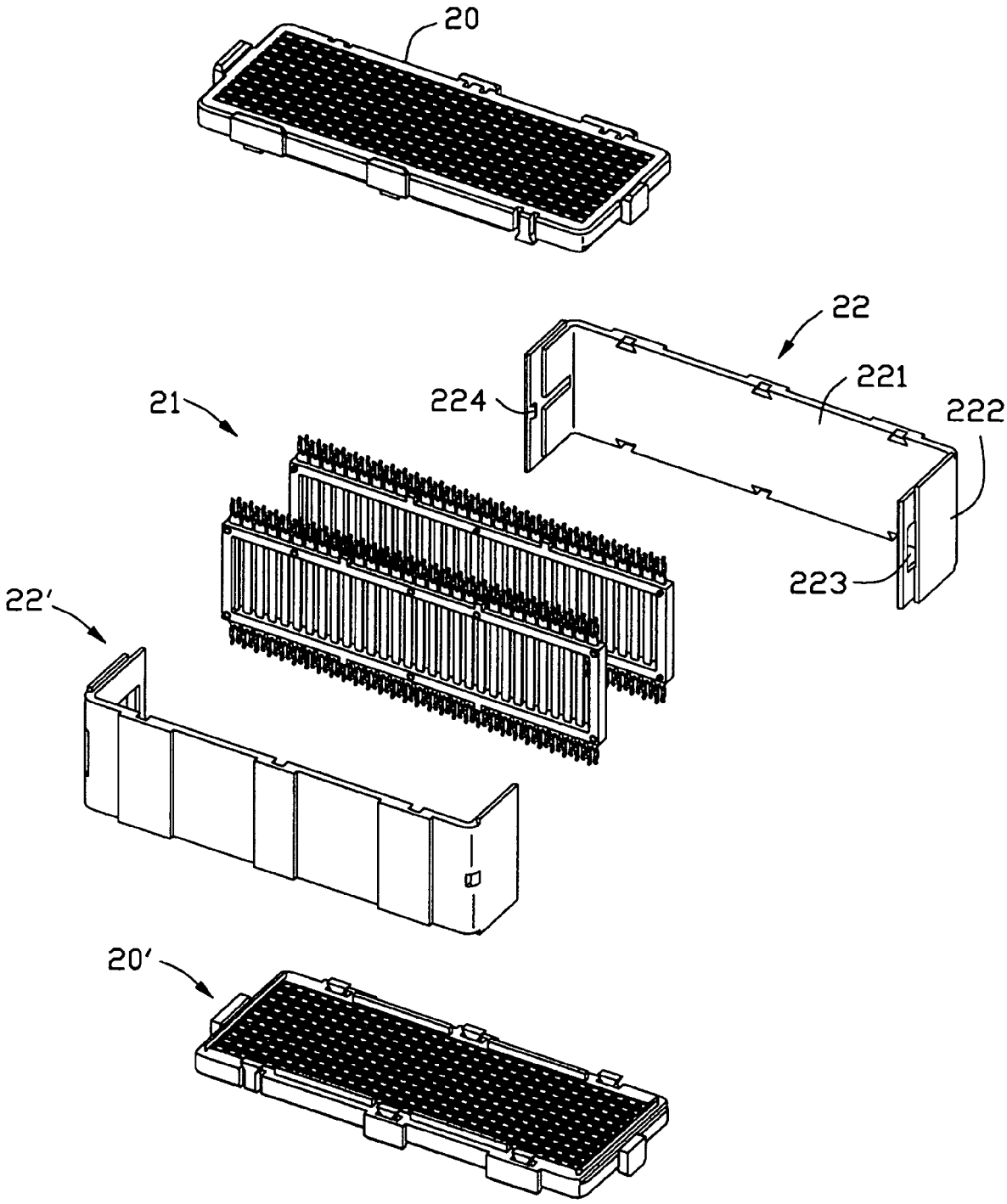
FIG. 3 is an exploded view of the mating extender.

As shown in FIG. 3, the mating extender 2 includes a subassembly of wafer 21, a pair of identical caps 20 disposed on a top portion and a bottom portion of the subassembly of wafer 21, and a pair of hermaphroditic plastic shroud-halves 22, 22' sliding on the subassembly of wafer 21 from opposite sides. The pair of shroud-halves 22 are locked to the two caps 20 to enclose the subassembly of wafer 21 and form the mating extender 2.

Figure 4:
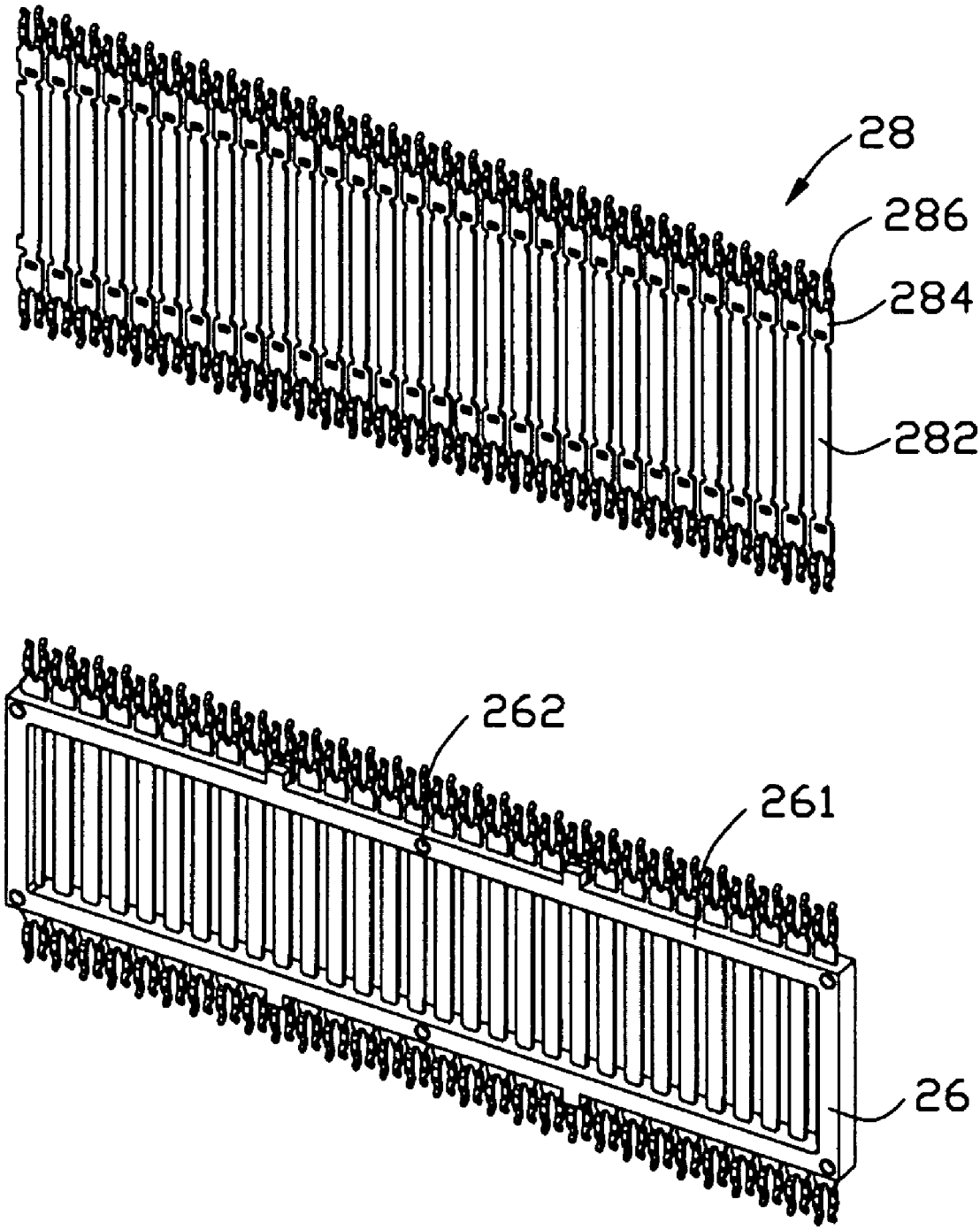
FIG. 4 is an exploded view of the wafer module.
Figure 5:
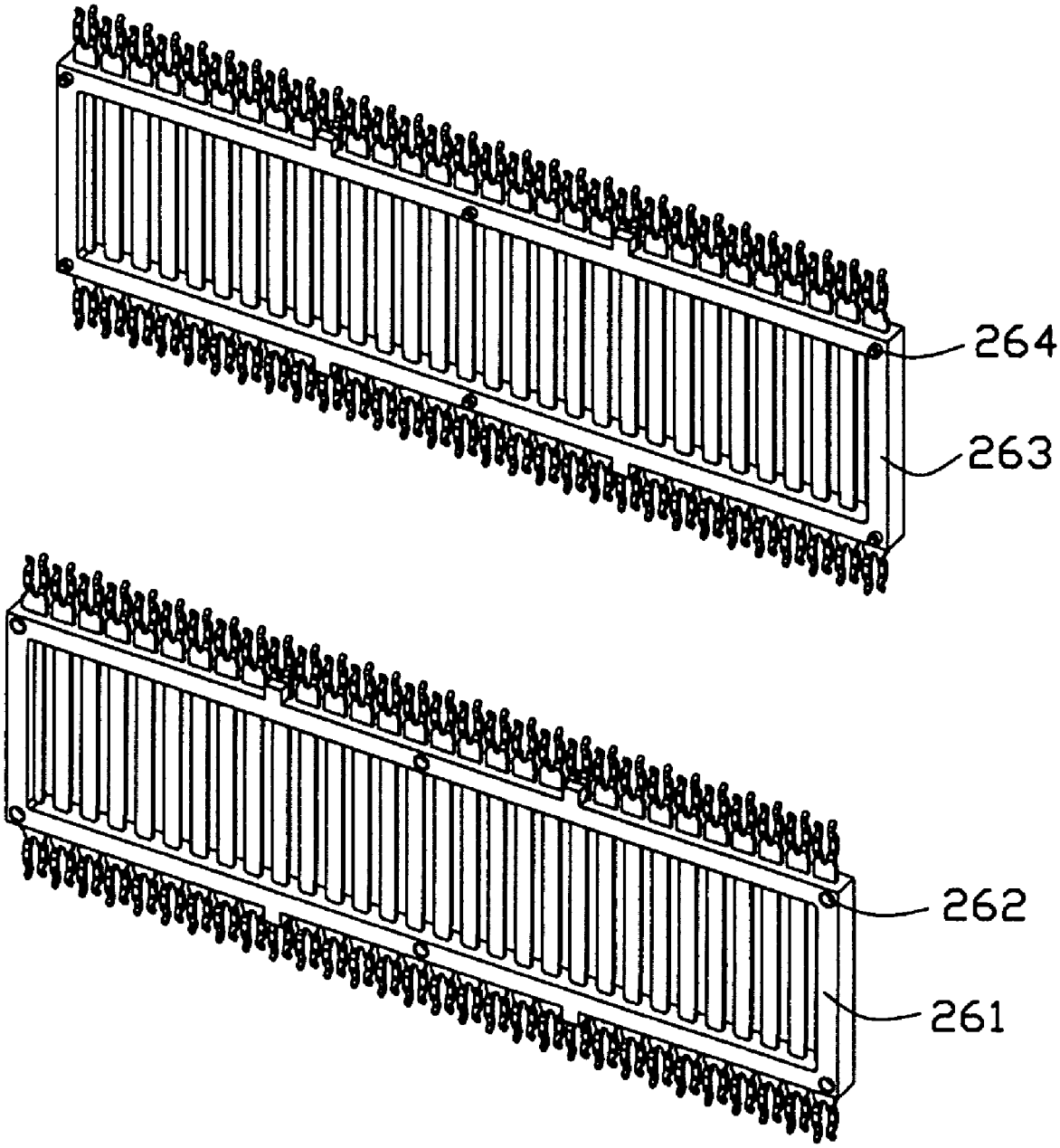
FIG. 5 is a perspective view of the wafer module showing the first and the second side thereof.

Further refer to FIGS. 3–4, the subassembly of wafer 21 includes a plurality of wafer modules 24 parallel to each other. Each wafer module 24 includes an insulative wafer support 26 and a plurality of stamped conductive contacts 28 insert molded in the wafer support 26 in a linear way. The wafer support 26 is generally a rectangular plastic frame and defines a first side 261 and a second side 262 opposite to the first side 261. The first side 261 defines a number of holes 262, while the second side 263 forms a plurality of posts 264 corresponding to the holes 262. It is to be noted that the posts 264 of one wafer module 24 are pressed into the holes 262 of the neighboring wafer module, thereby forming the subassembly of wafer 21. Each conductive contact 28 includes an intermediate portion 282 and a pair of mating ends or tail portions 284 formed on opposite free ends of the intermediate portion 282 and beyond the wafer support 26. Each mating end or tail portion 284 includes a pair of lateral offset cantilevered spring arms 286 for engaging with the receptacle connector 1' and the plug connector 1.

Each shroud-half 22 is generally C-shaped and includes a main body 221 and a pair of opposite arms 222 respectively laterally extending from opposite sides of the main body 221. One of the arms 222 defines a cutout 223 and the other arm 222 forms a latch 224, thus the latch 224 of one shroud-half 22 can latch with the cutout 223 of another hermaphroditic shroud-half 22', thereby locking with each other and enclosing the subassembly of wafer 21.

Figure 11:
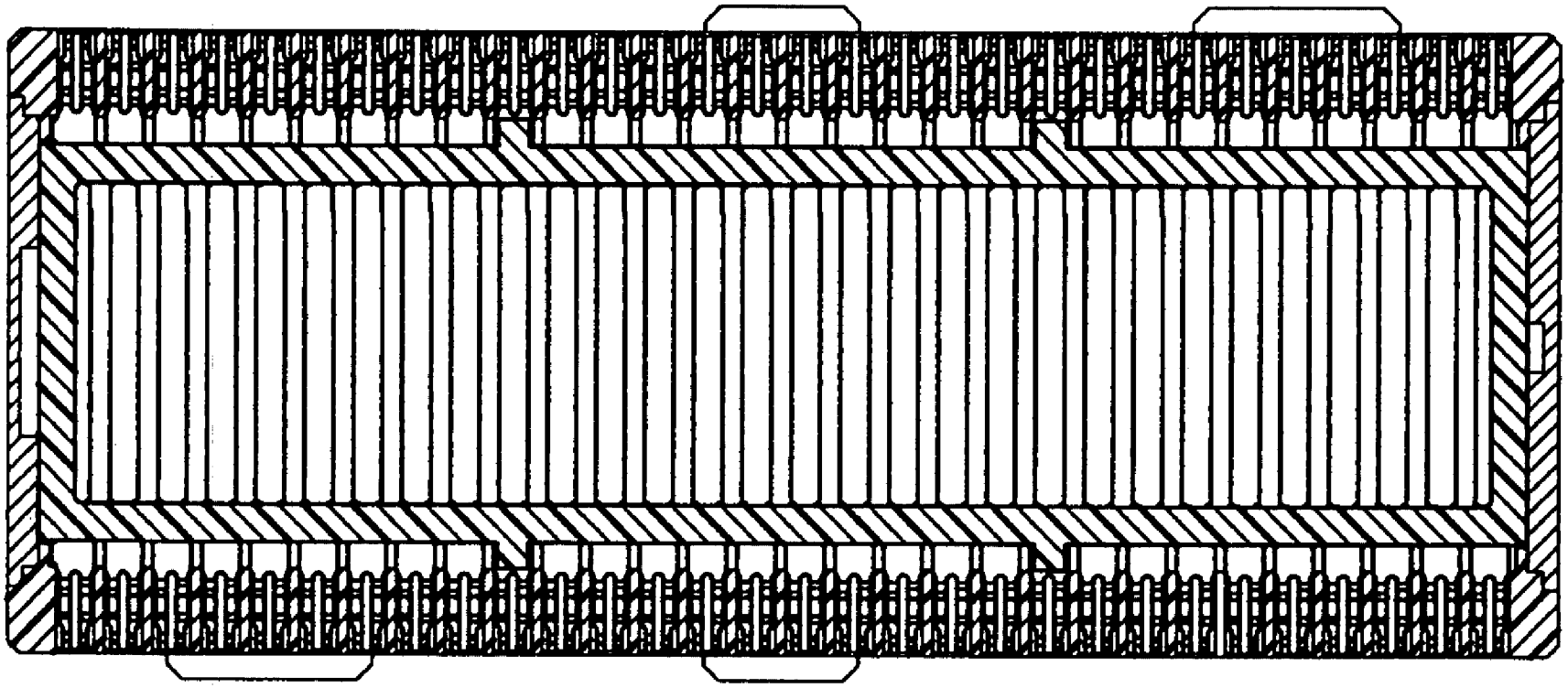
FIG. 11 is a cross section view of the mating extender.

The pair of caps 20 are respectively disposed on the top and bottom portions of the subassembly of wafer 21. Each cap 20 defines a plurality of slots 201 for receiving the tail portions 284 of conductive contacts 28 of the subassembly of wafer 21, as best shown in FIG. 11. Thus, the tail portions 284 of conductive contacts 28 do not expose outside of the mating extender 2, thereby not being prone to damage.

In this preferred embodiment, it is to be noted that the contacts 28, the wafer support 24 and the pair of hermaphroditic shroud-halves 22 can be made at various heights to determine the mating stack height that is needed.

Figure 6A:
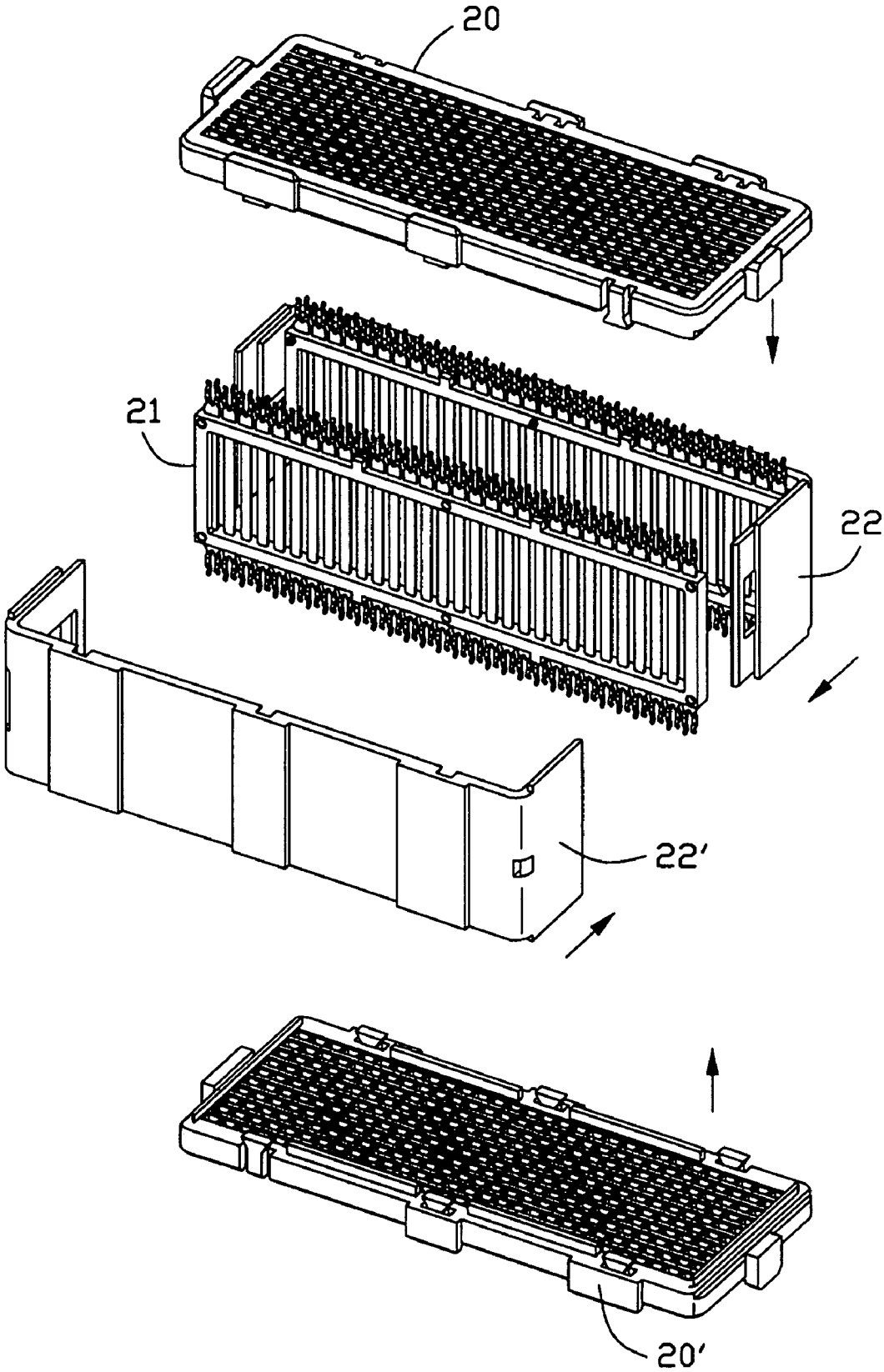
FIG. 6A is an exploded view of the mating extender with a shroud-half sliding on the subassembly of wafer module.
Figure 6B:
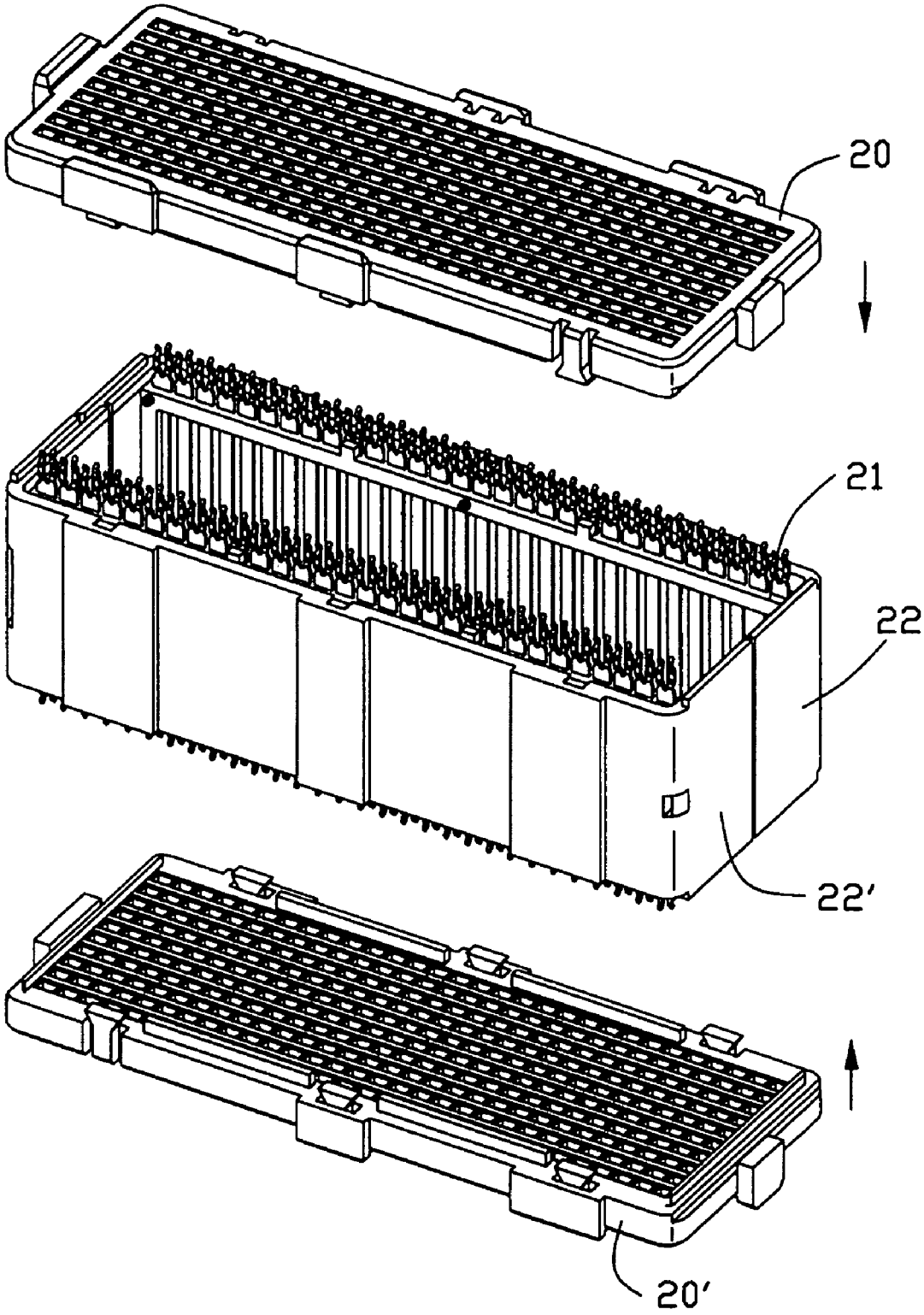
FIG. 6B is an exploded view of the mating extender with a pair of shroud-halves enclosing the subassembly of wafer module.

As shown in FIGS. 6A–6B, it discloses a first assembly embodiment of the mating extender 2. First, one shroud-half 22 slides on the subassembly of wafer 21 and another shroud-half 22' slides from opposite side on the subassembly of wafer 21 and latches with the above shroud-half. Second, the pair of caps 20 are disposed on the top and bottom portions of the subassembly of wafer 21.

Figure 7:
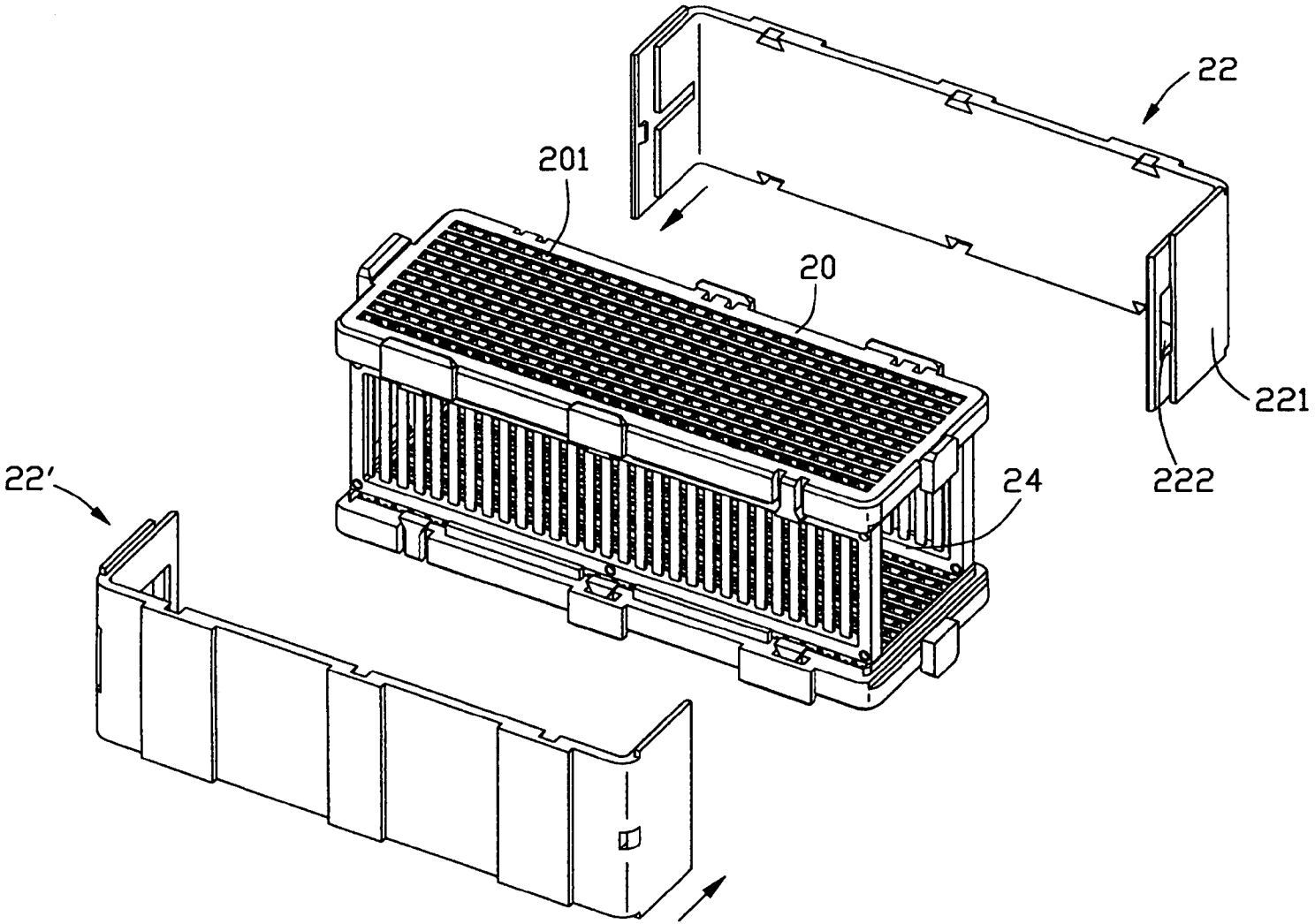
FIG. 7 is another exploded view of the mating extender with a pair of caps disposed on the subassembly of wafer.

Further refer to FIG. 7, it discloses a second assembly embodiment of the mating extender 2, which is contrary with the first assembly method in sequence. First, the pair of caps are disposed on the subassembly of wafer 21. Second, the pair of shroud-halves 22, 22' slide from opposite sides and locked to the two caps 20 to enclose the subassembly of wafer 21, thereby completing the mating extender 2.

Figure 8:
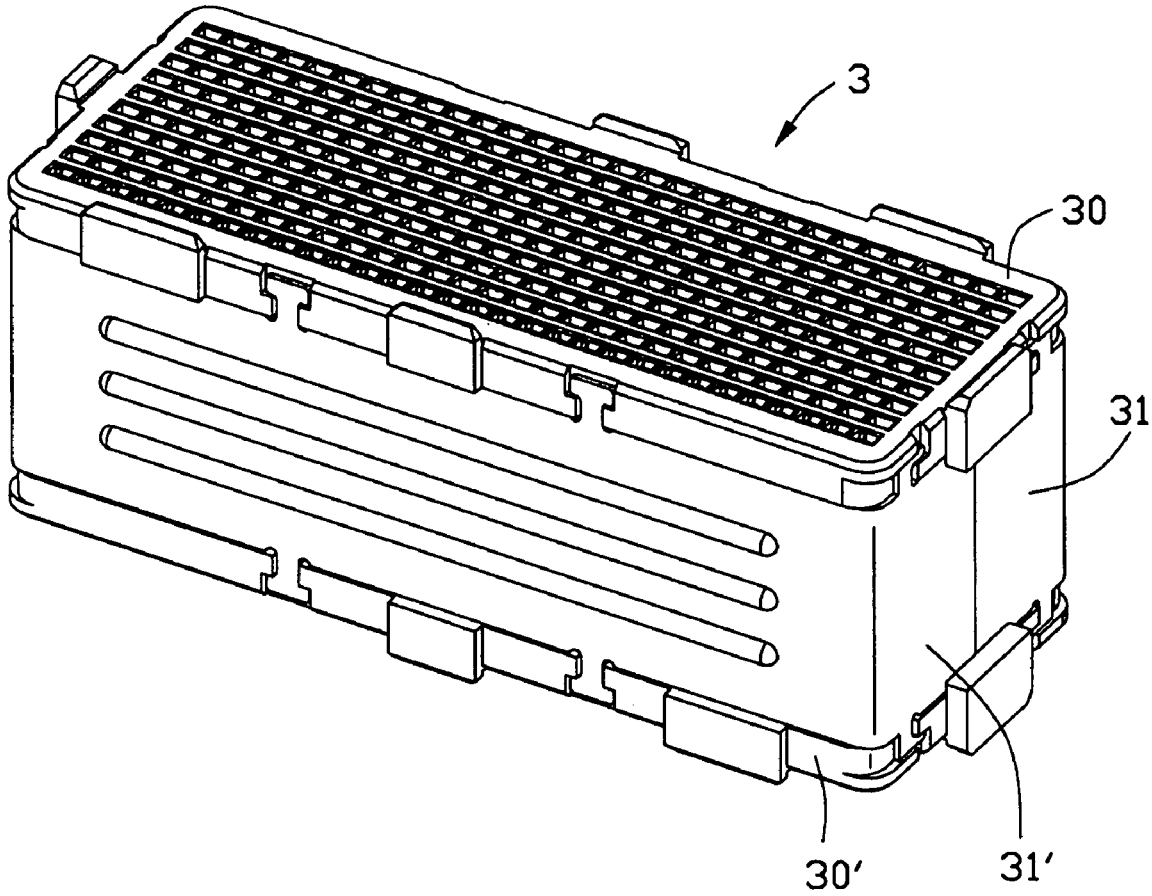
FIG. 8 is a perspective view of the mating extender according to a second embodiment of the present invention.
Figure 9:
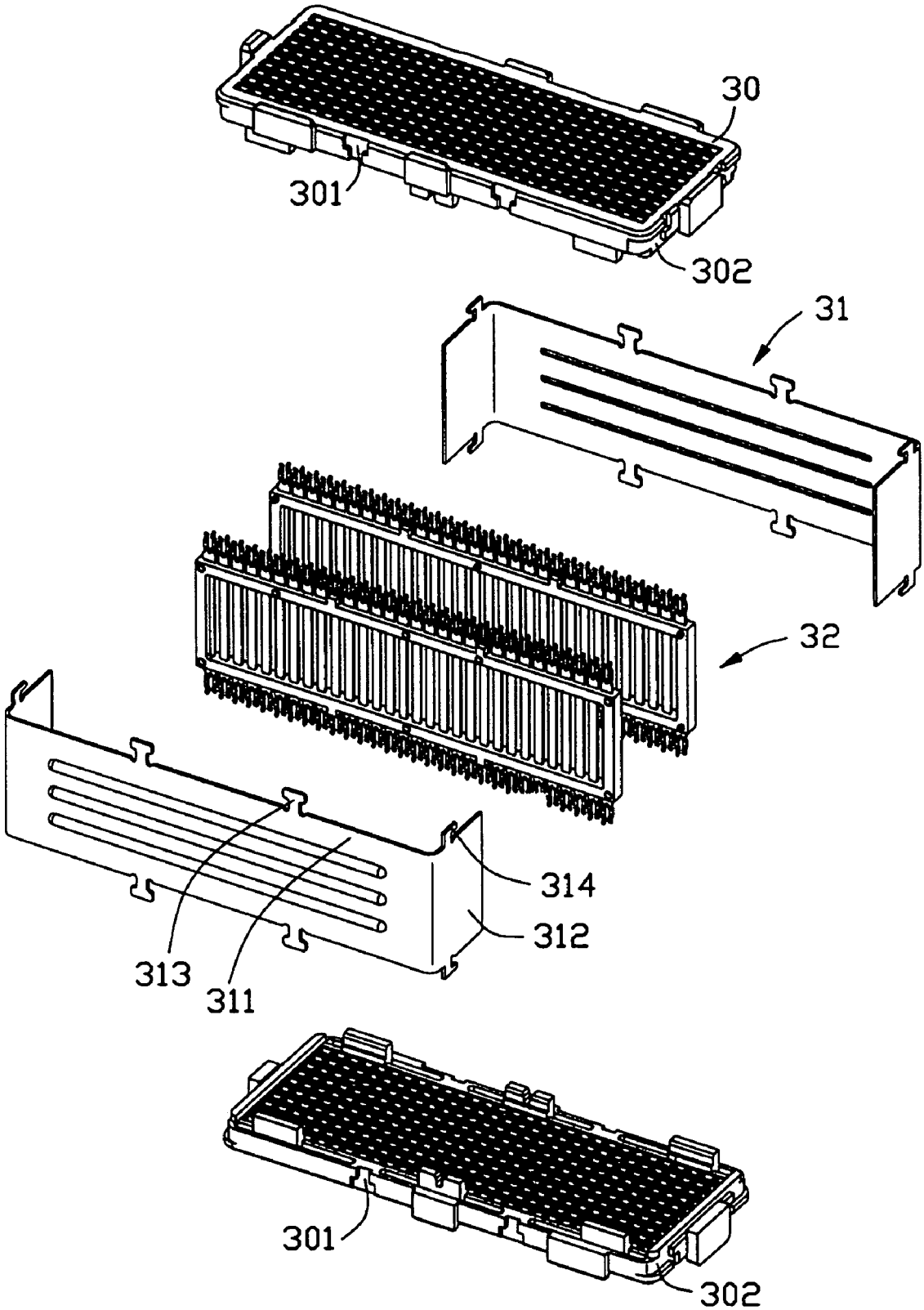
FIG. 9 is an exploded view of the mating extender shown in FIG. 8.

Further refer to FIGS. 8–9, it discloses a second embodiment of the mating extender 3 according to the present invention. The mating extender 3 is substantially identical to the mating extender 2 of the first embodiment except that the shroud-half is made up of metal piece. The mating extender 3 also includes a subassembly of wafer 32, a pair of identical caps 30, 30', and a pair of identical metal shroud-half 31. Since the structure of the subassembly of wafer 32 and the pair of caps 30, 30' are disclosed in the first embodiment of the mating extender 2, no detail description is given below.

In this embodiment, the shroud-half 31 is made up of a metal piece and generally C-shaped. Each shroud-half 31 includes a main body 311 and a pair of opposite arms 312 laterally extending from opposite sides of the main body 311. The main body 311 forms a number of T-shaped resilient latches 313 projecting beyond an upper and a lower edges thereof. Each arm 312 forms a pair of L-shaped latches 314 respectively projecting beyond a top and bottom edges thereof. Accordingly, the cap 30 defines a plurality of T-shaped recesses 301 and L-shaped recesses 302 at side walls (not labeled) thereof for respectively engaging with the T-shaped latches 313 and L-shaped latches 314 of the shroud-half 31 (as best shown in FIG. 8).

Figure 10:
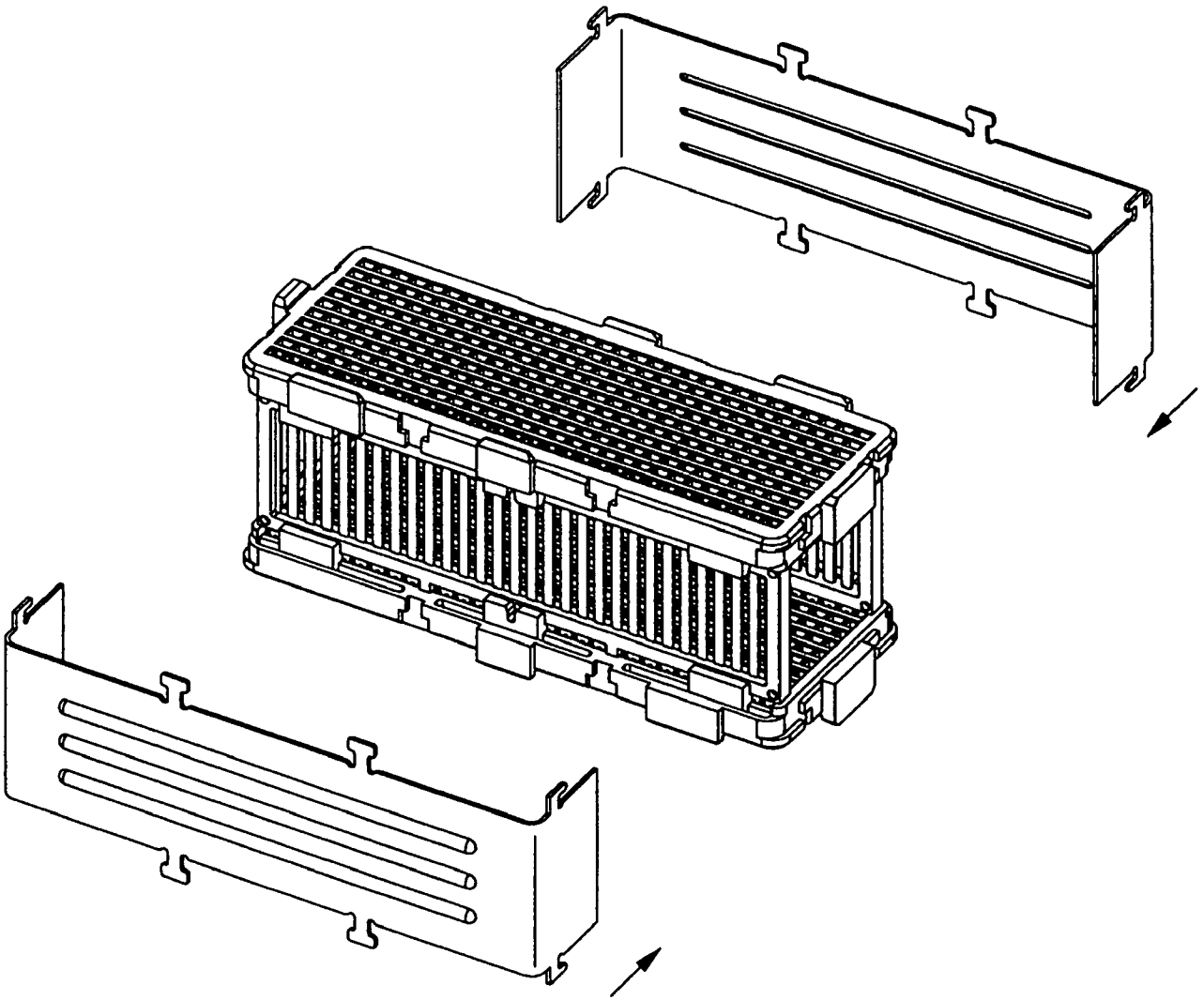
FIG. 10 is another exploded view of the mating extender with a pair of caps disposed on the subassembly of wafer.

The assembly process of the mating extender 3 is shown in FIG. 10. The pair of caps 30 are firstly disposed on the top and bottom portions of the subassembly of wafer 32. Secondly, the pair of metal shroud-halves 31 slide onto the subassembly of wafer 32 from opposite sides, wherein the T-shaped latches 313 and L-shaped latches 314 snap into the T-shaped recesses 301 and L-shaped recesses 302 of the cap 30, 30', thereby completing the mating extender 3.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A mating extender adapted for electrically connecting with two electrical connectors, comprising:

a subassembly having a plurality of parallel wafer modules, each wafer module having a wafer support and a plurality of contacts embedded in the wafer support, each contact defining a pair of mating ends extending beyond opposite sides of the wafer support;

a pair of shrouds mutually sliding onto the subassembly wafer modules and enclosing the subassembly;

a pair of caps attached to opposite sides of the two shrouds and cooperating with the shrouds to envelop the subassembly of wafer modules therebetween.

2. The mating extender according to claim 1, wherein each wafer support is a substantially rectangular frame and includes a first side and a second side opposite to the first side, the first side defining a plurality of posts and the second side defining a plurality of holes, and wherein the posts on each wafer support engage corresponding holes on the neighboring wafer support to hold the wafer supports together.

3. The mating extender according to claim 1, wherein each contact includes an intermediate portion received in the wafer support for interconnecting the two mating ends.

4. The mating extender according to claim 3, wherein each mating end includes a pair of laterally offset cantilevered arms, and wherein each cap defines a plurality of slots for receiving the pair of laterally offset cantilevered arms.

5. The mating extender according to claim 1, wherein the contacts are insert molded into the wafer support.

6. The mating extender according to claim 1, wherein each shroud includes a main body and a pair of arms laterally extending from opposite sides of the main body, one arm defining a cutout and the other arm forming a latch, and wherein the pair of shrouds lock with each other via the engagement between the latch of one shroud and the cutout of the other shroud.

7. The mating extender according to claim 1, wherein each shroud forms a plurality of latches, and wherein the caps define a plurality of recesses for receiving the latches of the shroud.

8. The mating extender according to claim 1, wherein the shroud is made of plastic material.

9. The mating extender according to claim 1, wherein the shroud is made of metal material.

10. An electrical connector assembly adapted for interconnecting with two parallel printed circuit boards, comprising:

a pair of electrical connectors adapted to be respectively mounted on the two parallel printed circuit boards, each electrical connector having a plurality of contacts received therein;

a mating extender disposed between the pair of parallel electrical connectors, comprising:

a subassembly composed by a plurality of parallel wafer modules, each wafer module having a wafer support and a plurality of contacts embedded in the wafer support and engaging with the contacts of the electrical connectors;

a shroud surrounding the subassembly; and a pair of caps respectively disposed on top and bottom sides of the subassembly and cooperating with the shroud enveloping the subassembly.

11. The electrical connector assembly according to claim 10, wherein the shroud forms a plurality of latches, and wherein the caps define a plurality of corresponding recesses for engaging with the latches.

12. An electrical connector assembly comprising:

a plurality of wafer modules side by side closely positioned one another in a first direction;

each of the wafer modules including a plurality of terminals disposed therein along a second direction perpendicular to the first direction;

each of said terminals extending along a third direction perpendicular to both said first and second directions, and defining at least one contacting portion at each end along the third direction, the terminals being arranged in a matrix defined by the first direction and the second direction;

a pair of caps dimensioned in compliance with the wafer modules in both said first and second directions, and defining a plurality of slots in the matrix corresponding to said terminals in said third direction so as to allow the contacting portions at each end of said terminals to be received in the corresponding slots.

* * * * *